United States Patent [19]

Kwon et al.

[11] Patent Number: 4,711,664

[45] Date of Patent: Dec. 8, 1987

[54] PROCESS FOR PRODUCING ZIRCONIUM SPONGE WITH A VERY LOW IRON CONTENT

[75] Inventors: Young J. Kwon, Fruit Heights; Susan M. Schulte, Ogden, both of Utah

[73] Assignee: Westinghouse Electric Corp., Pittsburgh, Pa.

[21] Appl. No.: 30,007

[22] Filed: Mar. 23, 1987

[51] Int. Cl.[4] ..... C22B 34/10

[52] U.S. Cl. ..... 75/84.5; 75/84.4; 423/76

[58] Field of Search ..... 75/84.5, 84.4; 423/76

[56] References Cited

U.S. PATENT DOCUMENTS

| | | | |
|---|---|---|---|
| 2,707,679 | 5/1955 | Lilliendahl et al. | 75/84 |
| 3,158,671 | 11/1964 | Socci | 75/84.5 |
| 3,839,020 | 10/1974 | Honma et al. | 75/84.5 |
| 3,880,652 | 4/1975 | Wehn et al. | 75/84.5 |
| 3,966,458 | 6/1976 | Spink | 75/84.5 |
| 4,105,192 | 8/1978 | Ishimatsu et al. | 75/84.5 |
| 4,127,409 | 11/1978 | Megy | 75/84.5 |
| 4,242,136 | 12/1980 | Ishizuka | 75/84.5 |
| 4,556,420 | 12/1985 | Evans et al. | 75/84.5 |
| 4,668,287 | 5/1987 | Kwon | 75/84.5 |

*Primary Examiner*—Stephen J. Lechert, Jr.
*Attorney, Agent, or Firm*—R. A. Stoltz

[57] ABSTRACT

A process for distilling zirconium sponge in an iron containing vessel at a temperature sufficiently low to preclude iron contamination of said sponge is disclosed. A distillation temperature near about 934° C. is sufficiently low to minimize iron contamination while being sufficiently high to cause sintering of the sponge to a degree that subsequent comminution does not produce excessive fines.

6 Claims, No Drawings

PROCESS FOR PRODUCING ZIRCONIUM SPONGE WITH A VERY LOW IRON CONTENT

BACKGROUND OF THE INVENTION

This invention relates to the production of zirconium, especially zirconium sponge, with a very low iron content.

State of the Art

Zirconium metal with a very low iron content is required for many applications. A primary existing technique for producing such metal has been to sublime zirconium tetrachloride in the presence of hydrogen to remove from the zirconium tetrachloride those higher melting or boiling impurities in the presence of hydrogen. This process is both energy and equipment inefficient; requiring additional heating and additional condensers to condense the zirconium tetrachloride.

However, it has been found that even using hydrogen sublimation to purify the zirconium tetrachloride prior to its reduction in the presence of magnesium, the sponge produced by distilling of the zirconium to remove any residual magnesium or magnesium chloride still contains significantly higher quantities of iron than often desirable due to contamination introduced in the distillation process.

A method for distillating zirconium sponge to remove magnesium and magnesium chloride is described in U.S. Pat. No. 4,242,136 of Ishizuka. Distillation is conducted at temperatures of about 1000° C. under a vacuum of about $10^{-2}$ mm Torr for several days or more. (Col. 4, lines 54 et seq.) Because of the length of the distillational cycle, Ishizuka discloses modifications to the reduction process to minimize the Mg and $MgCl_2$ content of the sponge and to form a more porous sponge. The technique of Ishizuka requires considerable modification of the reduction apparatus.

Ishizuka also discloses a technique for reducing contamination of zirconium sponge by causing the reduction of $ZrCl_4$ to occur near the center of the reduction crucible, away from the crucible wall. (Col. 6, lines 21 et seq.)

Distillation of zirconium in an iron container may result in iron contamination, as described in Lilliendahl, U.S. Pat. No. 2,707,679 at Col. 9, lines 3, et seq. Various techniques for precluding iron contamination are set forth in Lilliendahl at Col. 9, lines 3, et seq. and Col. 12, lines 3, et seq., which generally involve lining iron crucibles with another material such as calcium oxide or magnesium oxide or by substituting a molybdenum or tantalum cup.

SUMMARY OF INVENTION

It has now been discovered that the distillation of zirconium sponge containing residual magnesium and magnesium chloride at temperatures above 1000° C, usually about 1050–1100° C., in stainless steel vessels causes the zirconium sponge to pick up iron from the stainless steel vessel. Distillation of zirconium sponge at temperatures 1000° C and above has been conventional. It has generally been thought that such elevated temperatures were required not only to remove residual magnesium and magnesium chloride, but also to cause the sponge to sinter so that when the sponge was later pulverized a large quantity of unusable fines, i.e., less than about 20 mesh, would not be produced. However, it has now been discovered that vacuum distillation of zirconium sponge containing residual magnesium and magnesium chloride at temperatures below about 940° C and especially at a temperature of about 934° adequately sinters the sponge and removes the volatile magnesium and magnesium chloride without causing any significant pickup of iron from the stainless steel distillation vessel and without any excess of fines resulting when the sponge is pulverized.

DETAILED DESCRIPTION OF THE INVENTION

The instant invention relates to a technique for removing volatiles, for example magnesium and magnesium chloride, from zirconium sponge by distilling same at a temperature sufficiently high to remove said magnesium and magnesium chloride but below an elevated temperature which promotes the transport of iron from stainless steel lined distillation vessels into the zirconium sponge.

Zirconium metal is frequently produced by the chlorination of zircon sand in the presence of carbon to produce zirconium tetrachloride and silicon tetrachloride along with various chlorides of impurities such as phosphorus, iron, aluminum, titanium, thorium, uranium, and the like. Phosphorus and iron are particularly adverse impurities and significant purification process steps are employed to remove these from the zirconium tetrachloride. However, it has been found that even employing purification processes which produce a relatively low iron containing zirconiu tetrachloride, the resulting zirconium metal, after reduction of zirconium tetrachloride in the presence of magnesium and the distillation of the zirconium sponge to remove the residual magnesium and magnesium chloride, has a higher iron content than desirable.

In the practice of the instant invention, zirconium tetrachloride is reduced in a conventional Kroll-type reduction apparatus to yield zirconium sponge. Magnesium chloride is produced as a reaction product as well. The resulting zirconium sponge has some residual magnesium and magnesium chloride in it which is commonly removed by distillation. Practicing the technique of the instant invention, zirconium sponge containing residual magnesium and magnesium chloride is placed in a stainless steel lined vessel and heated to a temperature of about 934° for an extended period of about 25 hours or more, and especially for periods of about 30 hours or more, depending upon the amount of sponge being treated. The resulting zirconium sponge is substantially free from magnesium and magnesium chloride and has an iron content of substantially the same level as prior to the distillation. Further processing of zirconium sponge produced in this manner involves comminution of the zirconium sponge to produce particles in the range of about three-fourths inch to about 20 mesh for further processing. The pulverizing of such zirconium sponge resulted in fines no greater than about 1.8 % of the particles produced.

EXAMPLE

A zirconium sponge regulus of about 4200 pounds containing about 20% magnesium, and about 10% magnesium chloride was placed in a stainless steel lined distillation vessel. The vessel was placed in an electric furnace, subjected to a vacuum of about $10^{-1}$ Torr, and heated to a temperature in the neighborhood of about 934° for a period of about 31 hours. After the vessel was cooled, the zirconium regulus was crushed to produce particles having a mesh size range of about three-fourths inch to about 20 mesh. Fines, that is particles less than about 20 mesh, were present in a quantity less than about 1.8%. Analysis of the zirconium particles indicated substantially no detectable magnesium or magnesium chloride and the presence of iron at a level of about 225 ppm. All references to mesh are to Tyler Screen.

In comparison, a zirconium sponge regulus prepared in a similar way and having similar levels of magnesium and magnesium chloride was distilled in a vessel in a similar manner except that the temperature of distillation was maintained at about 1000° C. for about 26 hours. After cooling, the zirconium sponge regulus was pulverized in a similar manner, yielding particles in the range of about three-fourths inch to about 20 mesh with fines being less than about 1.5%. Analysis of the zirconium particles indicated no detectable magnesium or magnesium chloride and an iron level of about 759 ppm. Iron levels in this sponge were about three times as great as in the sponge distilled at 934° C. while no significant difference in fines resulted.

Distillation temperatures preferred in the practice of the instant invention are those below 940° C., which is the eutectic temperature for an iron-zirconium system, but at a temperature sufficiently high to remove effectively any residual Mg and $MgCl_2$. Also, the distillation temperature should sufficient to sinter the Zr sponge to yield a pulverized product having minimal fines. A distillation temperature of about 934° C. has been found very satisfactory since it is safely below the eutectic temperature of the Zr-Fe system. Temperatures as low as 930° C. may be effectively utilized.

The period of time during which distillation is conducted may vary depending upon the distillation temperature and the quantity of sponge. It should be sufficiently long to ensure substantially complete removal of all Mg and $MgCl_2$. Also, it should be sufficiently long to promote sufficient sintering of the sponge to prevent an excess of fines being formed upon comminution of the sponge. Time periods from about 25 to 35 hours are usually sufficient for such purposes.

Ultra pure zirconium has impurity contents of about the following:

| | |
|---|---|
| Oxygen | 300–400 ppm |
| Iron | 100–300 ppm |
| Hafnium | 50–100 ppm |
| Carbon | 20–50 ppm |
| Phosphorus | 20 ppm |
| All others | 100 ppm |

Production of zirconium sponge by the techniques of the instant invention consistently produces zirconium with iron content below 300 ppm. Purification of zirconium sponge by distillation of Mg and $MgCl_2$ at temperatures above 1000° C. yields sponges with iron values of a median of about 500 ppm, however, a significant amount of such purified sponges have an iron content above 1500 ppm.

We claim:

1. In a process for vacuum distilling zirconium sponge containing residual magnesium and magnesium chloride in a stainless steel lined vessel to remove said magnesium and magnesium chloride, the improvement of distilling same at a temperature below about 940° C. to prevent pickup of iron by the zirconium from the stainless steel lined vessel.

2. The process of claim 1 wherein said distillation is conducted at a temperature between about 930° and about 940° .

3. The process of claim 1 wherein said distillation is conducted at a temperature of about 934° C.

4. The process of claim 1 wherein said distillation is conducted over a period of time sufficient to remove substantially all of said magnesium and magnesium chloride.

5. The process of claim 1 wherein said distillation is conducted over a period of time sufficient to sinter said sponge sufficiently that an excessive amount of fines are not produced when said sponge is comminuted.

6. The process of claim 1 wherein said distillation is conducted over a period of about 25 hours or more.

* * * * *